US005720057A

United States Patent [19]

Duncan

[11] Patent Number: 5,720,057

[45] Date of Patent: Feb. 24, 1998

[54] DISASTER RELIEF BED

[76] Inventor: James B. Duncan, 739 Elm St., Graham, Tex. 76450

[21] Appl. No.: 625,536

[22] Filed: Mar. 28, 1996

[51] Int. Cl.[6] ..... A47C 27/14; A47G 9/06

[52] U.S. Cl. ..... 5/420; 5/692; 5/699; 5/740; 5/556

[58] Field of Search ..... 5/420, 692, 694, 5/698, 699, 737, 740, 722, 723, 655.9, 656, 626, 625

[56] References Cited

U.S. PATENT DOCUMENTS

| | | | |
|---|---|---|---|
| 65,262 | 5/1867 | Ouroussoff | 5/694 X |
| 308,454 | 6/1884 | Merli | D6/595 |
| 2,527,107 | 10/1950 | Strauss | 5/351 |
| 2,639,444 | 5/1953 | de Monsabert | 5/354 |
| 2,788,533 | 4/1957 | Bornstein | 5/344 |
| 3,268,922 | 8/1966 | Moxley | 5/420 |
| 3,477,552 | 11/1969 | Goldman | 190/2 |
| 4,295,235 | 10/1981 | Deitz | 5/656 X |
| 4,316,298 | 2/1982 | Russo et al. | 5/903 X |
| 4,329,747 | 5/1982 | Russell | 5/420 |
| 4,336,621 | 6/1982 | Schwartz et al. | 5/903 X |
| 4,450,193 | 5/1984 | Staebler | 5/420 X |
| 4,468,810 | 8/1984 | Longo | 383/3 |
| 4,504,990 | 3/1985 | Scales et al. | 5/698 |
| 4,905,990 | 3/1990 | DeSantis | 272/101 |
| 4,980,936 | 1/1991 | Frickland et al. | 5/420 |
| 5,022,111 | 6/1991 | Fenner, Sr. | 5/481 |
| 5,099,530 | 3/1992 | Scott | 5/420 |
| 5,110,219 | 5/1992 | Lopes | 383/4 |
| 5,203,041 | 4/1993 | Alonso | 5/420 |
| 5,210,891 | 5/1993 | Avital et al. | 5/420 |

FOREIGN PATENT DOCUMENTS

| | | | |
|---|---|---|---|
| 247760 | 9/1928 | United Kingdom | 5/625 |

*Primary Examiner*—Michael F. Trettel
*Attorney, Agent, or Firm*—Fulbright & Jaworski L.L.P.

[57] ABSTRACT

A portable mattress assembly adapted for use in disaster relief situations having mattress support material engineered to provide a suitable balance between portability and comfort. The mattress assembly includes a fabric envelope adapted to provide a rugged, waterproofed, posterior surface, with a pocket defined therein, in combination with a more supple, water resistant, anterior surface. The fabric envelope further includes fasteners disposed to temporarily attach the mattress assembly to a cot, stretcher staffs, or additional mattress assemblies. The mattress assembly may be folded and retained in accordion fashion and provides handles thereon for portage.

18 Claims, 2 Drawing Sheets

DISASTER RELIEF BED

TECHNICAL FIELD OF THE INVENTION

The present invention is directed to portable mattresses, and particularly to a mattress uniquely adapted for use in disaster relief.

BACKGROUND OF THE INVENTION

In disaster relief situations, often the victim has lost much of what is important in her life. It is often important for such an individual to be able to comfortably rest to help lessen the impact of the loss. Additionally, disaster relief personnel are often required to work long hours in adverse conditions and would equally welcome a comfortable resting place. Typically, disaster relief organizations are constrained by transportation means utilized to deliver disaster relief supplies to those affected. Such constraints typically limit the bulk and weight of disaster relief supplies to be transported to areas where needed. Therefore, any mattress used in disaster relief must generally be small and light. Such requirements require a trade off with comfort. Typically, a small light mattress lacks the combination of material density, thickness and Indentation Load Deflection (ILD) required to comfortably support an adult in the prone position. It is common for the manufacturer of a portable mattress to select material based solely on weight or thickness to meet design aspects of portability, rather than engineer a specific material whose characteristics achieve both portability and comfort.

Additionally, disaster relief situations require features not generally found in a typical portable mattress. Such features include surface durability, waterproofing, fire resistance, as well as flexibility of use. As a mattress for use in disaster relief is likely to see harsh conditions, it is necessary to protect it from such conditions with a rugged covering without loss of comfort or compact portability. Such extreme durability requirements are typically not addressed by traditional portable mattress design.

Furthermore, because it is often difficult to get relief supplies into a disaster area, it is valuable for such supplies to adequately serve multiple purposes. A typical limitation of portable mattresses is that in addition to their bulk, causing the mattress to occupy space that could otherwise be devoted to additional relief supplies, they serve only the function of a mattress upon which to rest. Aggravating this problem is the need to separately transport bedding material for use with portable mattress for use in disaster relief causing additional logistical problems in any relief effort.

There is clearly a need in the art for a mattress designed to address the unique needs of disaster relief. The present invention is directed to a mattress with features and engineering that meets that need.

SUMMARY OF THE INVENTION

As noted, the present invention addresses problems associated with providing an effective portable mattress in disaster relief situations. It is therefore a primary object of the present invention to provide a suitably light and portable mattress whose construction provides comfortable support for adults in a prone position. A resulting technical advantage of the present invention is that the mattress support material is engineered to provide a suitable balance between portability and comfort. After substantial experimentation, a specific range of combinations of thickness, density, and ILD in the material has been found to provide optimum comfort and support for the resting victim or relief worker, while still maintaining a manageable bulk and weight to serve in disaster relief situations. In particular, materials whose characteristics meet these predetermined criteria have been demonstrated to give full support to the prone user, while effectively shielding the user from feeling irregularities on the ground surface beneath the mattress.

A further technical advantage of the present invention is that it provides a mattress in which a fabric envelope incarcerating the support material is rugged and waterproof while maintaining a comfortable surface upon which to rest. The present invention achieves this result by providing a rugged, waterproofed, fabric membrane on the posterior surface of the envelope in combination with a more supple, water resistant, fabric membrane on the anterior surface of the envelope. It will be appreciated that such a dual composition envelope is advantageous in a disaster relief situation as the rugged posterior surface may be placed in contact with wet or abrasive surfaces without damage while the more supple anterior surface is disposed to provide a comfortable surface on which to rest.

A still further advantage of the present invention is that it is disposed to being folded in an accordion fashion for storage and portability, and may be retained when folded in this fashion advantageously by a webbing belt secured by a fastener such as a buckle or a friction contact grip fastener. The envelope also advantageously includes means for gripping and carrying the mattress when folded, such as reinforced webbing handles attached on edges of the envelope.

A yet further technical advantage of the present invention is that the envelope provides a pocket in which to receive bedding material, such as blankets, to be later utilized in conjunction with the mattress. It will be appreciated that by retaining such bedding material in this pocket, the transportation of an entire bedding ensemble is facilitated.

A still further advantage of the present invention is its ability to be combined and adapted in use to provide additional features. The present invention advantageously includes fasteners attached to the envelope, such as webbing straps with hook and loop fasteners, whereby the mattress may be temporarily attached to a cot to provide a yet more comfortable resting surface. These fasteners may be further disposed to receiving staffs so as to enable the mattress to be borne as a stretcher. Finally, these fasteners may be disposed to attach several mattresses together so as to provide a larger or thicker resting surface.

It will be appreciated that, in consideration of its use in disaster relief situations, the padding and envelope materials are advantageously selected to have inherently fire retardant characteristics. In a case, however, where such materials are unavailable, the mattress and envelope materials may be pre-treated with a fire retardant additive to achieve the desired attribute.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
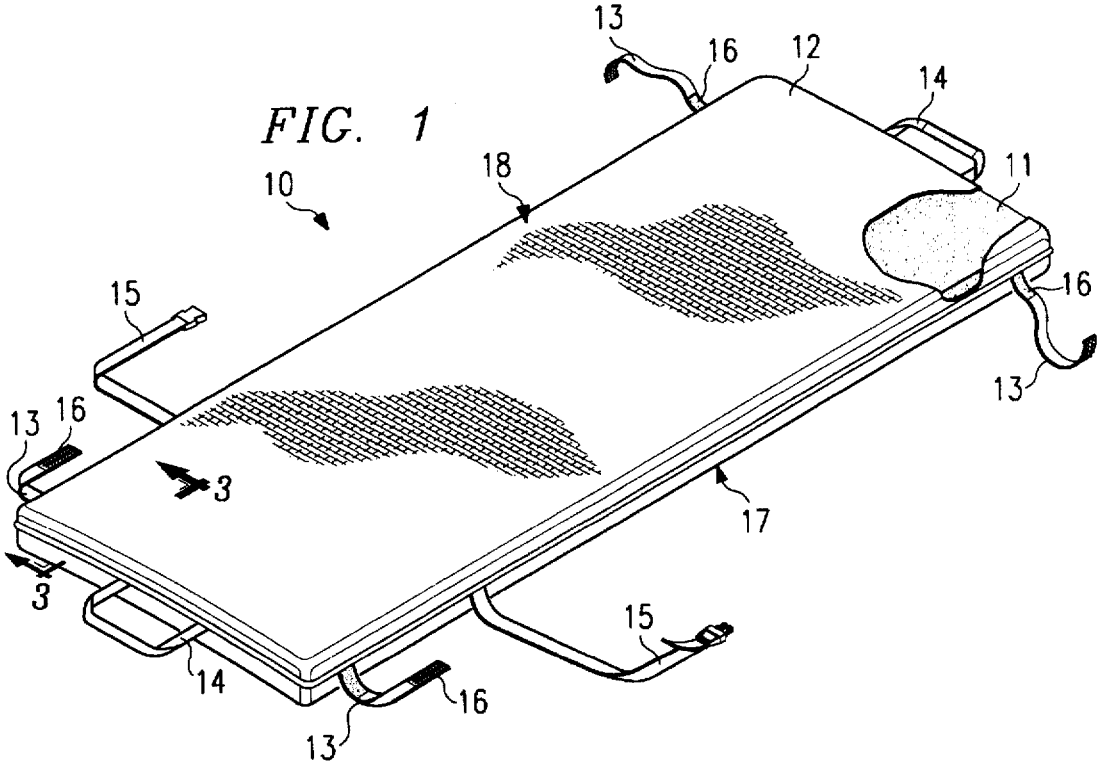
FIG. 1 is a perspective view showing anterior surface 18 of mattress assembly 10, including a cut-away view through fabric envelope 12 revealing pad 11.

With reference to FIG. 1, mattress assembly 10 comprises a generally planar pad 11 having posterior surface 17 and anterior surface 18. Although it will be understood that pad 11 may be made from any suitable resilient material of appropriate dimensions, pad 11 is advantageously made from a urethane foam, sized 72–78 inches in length and 24–28 inches in width. Fabric envelope 12 incarcerates pad 11 with a plurality of straps 13, advantageously four thereof, permanently attached thereto. Further discussed below, handles 14 and belts 15 also attach to fabric envelope 12.

The resilient foam of pad 11 is further advantageously engineered to meet design parameters important to use of a mattress in disaster relief situations. Such parameters include predetermined foam density, thickness and Indentation Load Deflection (ILD). Experimentation has determined that optimum low weight and portability in combination with adequate support for a prone adult may be achieved when pad 11 is made of a homogeneous resilient urethane foam with density, thickness and ILD falling within the following ranges:

| | Minimum | Maximum |
|---|---|---|
| Density (lbs./ft.$^3$) | 1.5 | 2.5 |
| Thickness (in.) | 1.5 | 2.5 |
| ILD | 35 | 50 |

It will be understood that any resilient material whose density, thickness and ILD fall within these ranges may advantageously be used as pad 11.

In a presently preferred embodiment of the invention, the ILD value of pad 11 is selected to be 40 and the density to be not more than 2.0 and not less than 1.8 pounds per cubic foot. Additionally, pad 11 may be advantageously disposed to be fire retardant. In a preferred embodiment, pad 11 may be treated with a fire retardant substance such as FYROL PBR.

As further illustrated on FIG. 1, fabric envelope 12 completely incarcerates pad 11, and includes features important to the use of a mattress in disaster relief situations. Such features include fabric envelope 12 also advantageously disposed to be fire retardant. In a preferred embodiment, fabric envelope 12 may be treated with a fire retardant substance such as FYROL PBR.

As noted above, and as illustrated on FIG. 1, fabric envelope 12 provides straps 13 permanently attached thereto. In one application, straps 13 are suitable for temporarily attaching mattress assembly 10 to a cot so as to combine to form a bed. Straps 13 are advantageously provided along the longer sides of mattress assembly 10, as depicted on FIG. 1, and near the corners thereof, so as to conveniently attach mattress assembly 10 to the corners of the exposed frame of a general purpose cot. In another application, straps 13 become suitable for temporarily attaching mattress assembly 10 to staffs or poles, thereby enabling mattress assembly 10 to be borne as a stretcher. In a third application, straps 13 become suitable for temporarily fastening multiple ones of mattress assembly 10 together to fashion a thicker mattress or a larger mattress surface. In a preferred embodiment of the invention, straps 13 include hook and loop fasteners 16 disposed such that straps 13 may be temporarily fastened upon themselves. It will be understood that such fastening ones of straps 13, using hook and loop fasteners 16, each form a loop suitable for retaining mattress assembly 10 on a cot or stretcher staff. It will be further understood that straps 13 may include any number of other fasteners, such as friction contact grip fasteners or ties, suitable for retaining mattress assembly 10 on a cot or stretcher staff.

Fabric envelope 12 further includes belts 15 permanently attached thereto. Now referring to FIG. 2, it will be understood that mattress assembly 10 is disposed to be folded generally in accordion fashion, although there is no particular requirement for fold lines preformed into pad 11. As further shown on FIG. 2, belts 15 are disposed to retain mattress assembly 10 in the accordion folded fashion.

Figure 2:
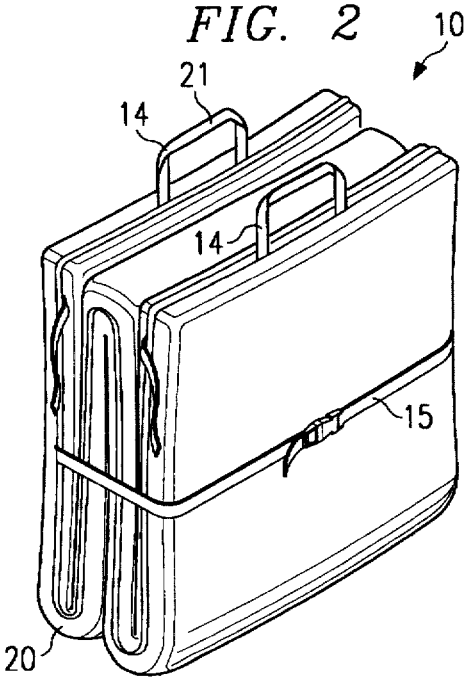
FIG. 2 is a perspective view of mattress assembly 10 retained in a folded fashion by belts 15, with handles 14 disposed for transporting mattress assembly 10.
Figure 2A:
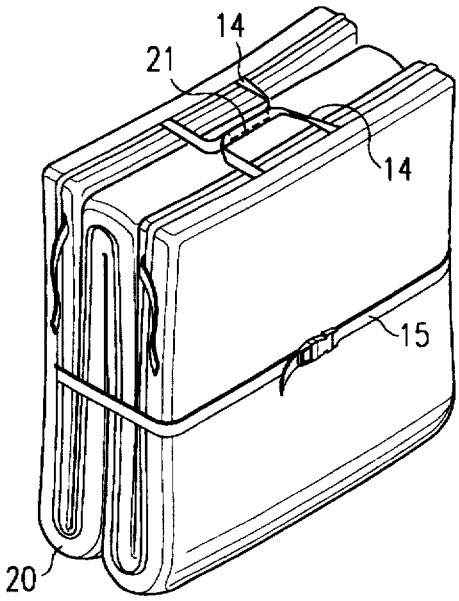
FIG. 2A is a perspective view of mattress assembly 10 retained in a folded fashion, as shown in FIG. 2, illustrating an alternative embodiment of the present invention wherein handles 14 may be fastened together into a single handle unit by fasteners 21.

Still referring to FIG. 2, it will be understood that fabric envelope 12 further includes handles 14. Handles 14 are disposed to facilitate portage of mattress assembly 10 when same is retained in the accordion folded fashion as depicted by FIG. 2. In the presently preferred embodiment of the invention, handles 14 are constructed of a reinforced webbing permanently attached to fabric envelope 12 by machine stitching. As depicted in FIG. 2A, handles 14 may advantageously include hook and loop fasteners 21 wherein handles 14 may be interconnected to form a single handle unit. It will be further understood that handles 14 may include any number of other fasteners, such as friction contact grip fasteners or ties, suitable for interconnecting handles 14 to form a single handle unit. As depicted in FIG. 2, handles 14 are advantageously provided along a shorter edge of mattress assembly 10 such that, when mattress assembly 10 is retained in the accordion folded fashion, handles 14 may be located at the top of folded mattress assembly 10. It will be understood that fabric envelope 12 advantageously may include only a single handle 14.

Figure 3:
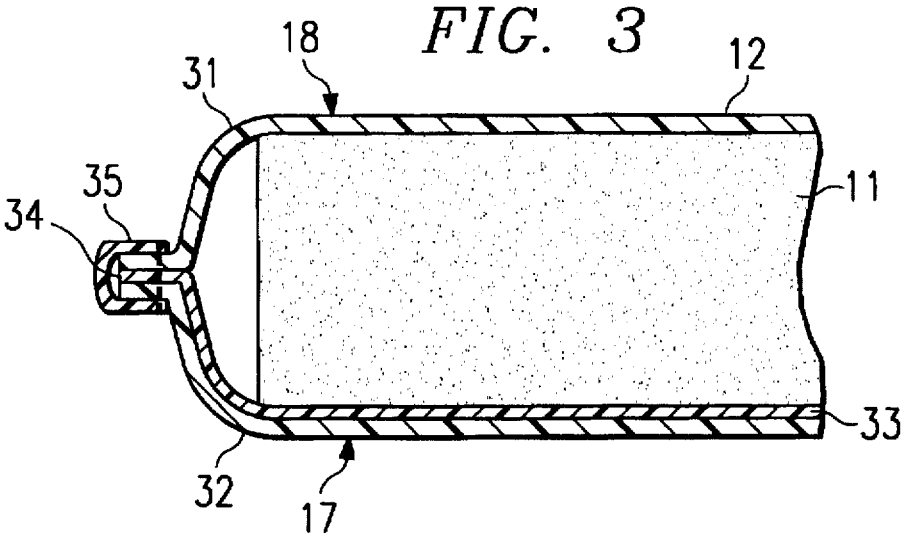
FIG. 3 is a partial cross-sectional view of mattress assembly 10 as shown on FIG. 1, illustrating components of fabric envelope 12 including anterior surface membrane 31, posterior surface membrane 32, water proofing membrane 33, and seal 34.

Now referring to FIG. 3, depicting a cross section of mattress assembly 10 as shown on FIG. 1, it will be understood that fabric envelope 12 includes anterior fabric membrane 31 covering anterior surface 18 and posterior fabric membrane 32 covering posterior surface 17. In a preferred embodiment of the invention, anterior fabric membrane 31 is made of a 200 denier nylon treated to be water repellant, and posterior fabric membrane 32 is made of a 430 denier nylon treated to be waterproof. In order to make posterior fabric membrane 32 waterproof, it is advantageously is backed with waterproofing membrane 33, such as a urethane coating permanently adhered to posterior fabric membrane 32, as depicted on FIG. 3.

Still referring to FIG. 3, seal 34 between anterior fabric membrane 31 and posterior fabric membrane 32 may be any known suitable bonding means. Advantageously, seal 34 may be accomplished by machine stitching. It should also be understood that seal 34 may advantageously be covered by a folded strip of fabric membrane 35 in order to make the seal more appealing to the eye, more durable, or more water-resistant.

Figure 4:
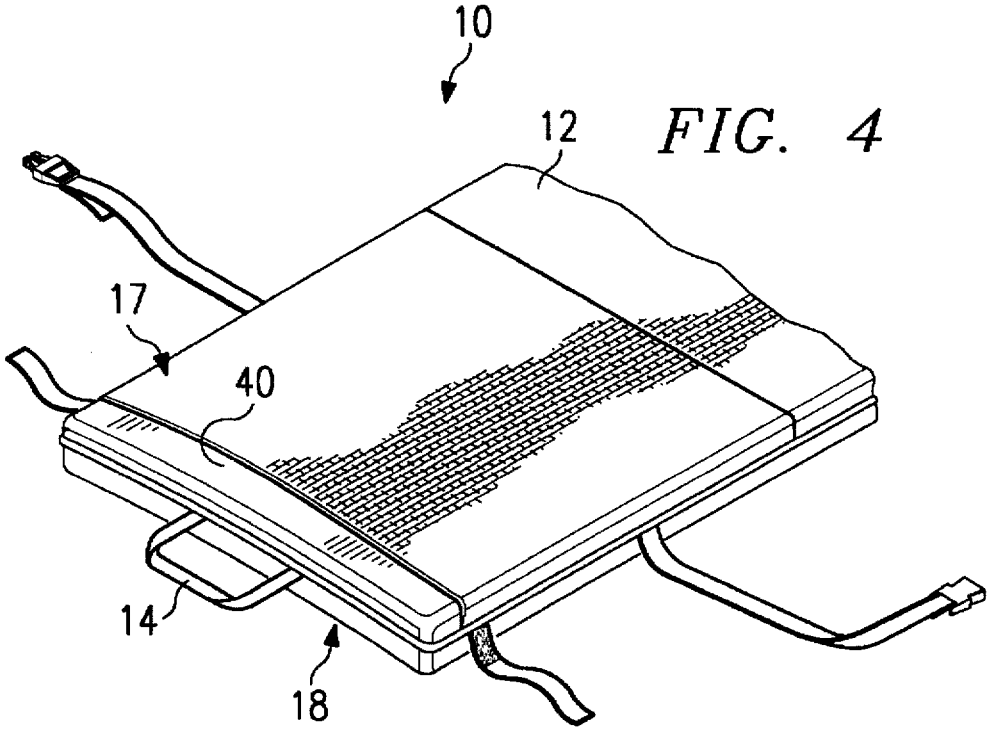
FIG. 4 is a partial perspective view of posterior surface 17 of mattress assembly 10 illustrating pocket 40 provided in fabric envelope 12.

Now referring to FIG. 4, a preferred embodiment of the invention is depicted wherein fabric membrane 32, covering posterior surface 18, provides pocket 40 in fabric envelope 12. Pocket 40 may advantageously allow storage of bedding material to be later utilized in conjunction with mattress assembly 10. Advantageously pocket 40 may be made of the same material as fabric membrane 32. Pocket 40 is advantageously fastened to fabric membrane 32 on three sides by machine stitching or any other suitable fastening means. Directing attention to FIG. 2, the location of the first accordion fold is depicted as apex 20. Preferably, pocket 40 runs lengthwise to apex 20 as indicated in FIG. 4. Advantageously, pocket 40 is the full width of posterior surface 17.

Although the present invention and its advantages have been described in detail, it should be understood that various changes, substitutions and alterations can be made herein without departing from the spirit and scope of the invention as defined by the appended claims.

I claim:

1. A mattress, comprising:

a pad, the pad made from a substantially homogeneous resilient material, the pad substantially planar in shape, the pad having a predetermined substantially uniform thickness of not less than 1.5 inches and not more than 2.5 inches, the pad disposed to be folded in accordion fashion into a predetermined number of substantially equal elements;

said resilient material having a predetermined substantially uniform density of not more than 2.5 and not less than 1.5 pounds per cubic foot, the resilient material also having a predetermined substantially uniform ILD value of not more than 50 and not less than 35;

means for retaining the mattress folded together when the mattress is folded in said accordion fashion;

a fabric envelope, the fabric envelope completely incarcerating the pad, the fabric envelope having an anterior surface and a posterior surface, the anterior surface of the fabric envelope made from a membrane of approximately 200 denier fabric, the anterior surface disposed to be water-repellant, the posterior surface of the envelope made from a membrane of approximately 430 denier fabric, the posterior surface disposed to be waterproof;

at least one handle means, the at least one handle means attached to the fabric envelope, the at least one handle means disposed to facilitate portage of the mattress when the pad is folded in said accordion fashion; and the fabric envelope further providing a plurality of tying means, the tying means disposed to temporarily attach the fabric envelope to a cot, said tying means also disposed for receiving two or more staffs, said tying means further disposed for temporarily interconnecting multiple ones of said mattress together.

2. The mattress set forth in claim 1 wherein said resilient material is also disposed to be fire retardant.

3. The mattress set forth in claim 1 wherein said fabric envelope is further disposed to be fire retardant.

4. The mattress set forth in claim 1 wherein said fabric envelope further comprises an outer pocket therein.

5. A mattress, comprising:

a pad having anterior and posterior surfaces, the pad made from a substantially homogeneous resilient material, the pad substantially planar in shape, the pad having a predetermined thickness, the pad disposed to be folded in accordion fashion into a predetermined number of substantially equal elements, wherein the anterior surfaces of ones of said substantially equal elements face each other and the posterior surfaces of ones of said substantially equal elements face each other when the pad is folded in said accordion fashion;

said resilient material having a predetermined density, the resilient material also having a predetermined ILD value; and a fabric envelope, the fabric envelope completely incarcerating the pad, wherein said fabric envelope comprises a plurality of tying means, the tying means disposed to temporarily attach the fabric envelope to a cot, said tying means also disposed for receiving two or more staffs, said tying means further disposed for temporarily interconnecting multiple ones of said mattress together.

6. The mattress set forth in claim 5 wherein said predetermined thickness is selected from the group consisting of thicknesses not less than 1.5 inches and not more than 2.5 inches.

7. The mattress set forth in claim 5 wherein said predetermined density is selected from the group consisting of densities not more than 2.5 and not less than 1.5 pounds per cubic foot.

8. The mattress set forth in claim 5 wherein said predetermined ILD value is selected from the group consisting of ILD values not more than 50 and not less than 35.

9. A mattress, comprising:

a pad, the pad made from a substantially homogeneous resilient material, the pad substantially planar in shape, the pad having a predetermined substantially uniform thickness of not less than 1.5 inches and not more than 2.5 inches, the pad disposed to be folded in accordion fashion into a predetermined number of substantially equal elements;

said resilient material having a predetermined substantially uniform density of not more than 2.5 and not less than 1.5 pounds per cubic foot, the resilient material also having a predetermined substantially uniform ILD value of not more than 50 and not less than 35, the resilient material also disposed to be fire retardant;

a fabric envelope, the fabric envelope completely incarcerating the pad; and means for retaining the mattress folded together when the mattress is folded in said accordion fashion, wherein an anterior surface of a first one of said substantially equal elements and an anterior surface of a second one of said substantially equal elements are substantially adjacent when the mattress is retained in said accordion fashion by said retaining means.

10. The mattress set forth in claim 9 wherein said fabric envelope comprises an anterior surface and a posterior surface, the anterior surface of the fabric envelope made from a membrane of approximately 200 denier fabric, the anterior surface disposed to be water-repellant, the posterior surface of the envelope made from a membrane of approximately 430 denier fabric, the posterior surface disposed to be waterproof.

11. The mattress set forth in claim 9 wherein said fabric envelope comprises an outer pocket therein.

12. The mattress set forth in claim 9 wherein said fabric envelope is disposed to be fire retardant.

13. The mattress set forth in claim 9 wherein said fabric envelope comprises at least one handle means, the at least one handle means attached to the fabric envelope, the at least one handle means disposed to facilitate portage of the mattress when the pad is folded in said accordion fashion.

14. The mattress set forth in claim 9 wherein said fabric envelope comprises a plurality of tying means, the tying means disposed to temporarily attach the fabric envelope to a cot, said tying means also disposed for receiving two or more staffs, said tying means further disposed for temporarily interconnecting multiple ones of said mattress together.

15. A mattress, comprising:

a pad, the pad made from a substantially homogeneous resilient material, the pad substantially planar in shape, the pad having a predetermined thickness, the pad disposed to be folded in accordion fashion into a predetermined number of substantially equal elements;

said resilient material having a predetermined density, the resilient material also having a predetermined ILD value, wherein said predetermined ILD value is selected from the group consisting of ILD values not more than 50 and not less than 35; and a fabric envelope, the fabric envelope completely incarcerating the pad, wherein said fabric envelope comprises at least one handle means, the at least one handle means attached to the fabric envelope, the at least one handle means disposed to facilitate portage of the mattress when the pad is folded in said accordion fashion.

16. The mattress set forth in claim 15 wherein said predetermined thickness is selected from the group consisting of thicknesses not less than 1.5 inches and not more than 2.5 inches.

17. The mattress set forth in claim 15 wherein said predetermined density is selected from the group consisting of densities not more than 2.5 and not less than 1.5 pounds per cubic foot.

18. The mattress set forth in claim 15 wherein said fabric envelope comprises a plurality of tying means, the tying means disposed to temporarily attach the fabric envelope to a cot, said tying means also disposed for receiving two or more staffs, said tying means further disposed for temporarily interconnecting multiple ones of said mattress together.

* * * * *